US009394768B2

(12) United States Patent
Pasvandi

(10) Patent No.: US 9,394,768 B2
(45) Date of Patent: Jul. 19, 2016

(54) HYDROMECANICAL PIERCING PERFORATOR AND METHOD OF OPERATION THEREOF

(71) Applicant: Marie Pasvandi, Mesa Geitona (CY)

(72) Inventor: Marie Pasvandi, Mesa Geitona (CY)

(73) Assignee: Passerby Inc., Providence, Mahe (SC)

( * ) Notice: Subject to any disclaimer, the term of this patent is extended or adjusted under 35 U.S.C. 154(b) by 248 days.

(21) Appl. No.: 14/040,988

(22) Filed: Sep. 30, 2013

(65) Prior Publication Data

US 2015/0090454 A1 Apr. 2, 2015

(51) Int. Cl.
*E21B 43/112* (2006.01)

(52) U.S. Cl.
CPC ..... *E21B 43/112* (2013.01)

(58) Field of Classification Search
CPC ..... E21B 43/112; E21B 43/114; E21B 49/10; E21B 29/00; E21B 29/08; Y10T 83/9314
See application file for complete search history.

(56) References Cited

U.S. PATENT DOCUMENTS 2,381,929 A * 8/1945 Schlumberger ..... 166/55.1
2,540,123 A * 2/1951 Kinley ..... E21B 43/082 166/228
2,594,654 A * 4/1952 Jobe ..... E21B 29/02 166/55.3
2,638,801 A * 5/1953 Klaasen et al. ..... 166/55.3
2,760,580 A * 8/1956 Johnston ..... 166/120
3,411,597 A * 11/1968 Kinley ..... E21B 17/06 166/63
4,165,784 A * 8/1979 Gardner ..... 166/55.3
5,007,479 A * 4/1991 Pleasants et al. ..... 166/178
5,183,111 A * 2/1993 Schellstede ..... 166/298
6,155,150 A * 12/2000 Cooper et al. ..... 83/13
6,209,635 B1 * 4/2001 Gotlib et al. ..... 166/117.5
2012/0168167 A1 * 7/2012 Baugh ..... 166/338
2014/0374100 A1 * 12/2014 Hallundbaek et al. ..... 166/298

* cited by examiner

*Primary Examiner* — Kipp Wallace
(74) *Attorney, Agent, or Firm* — Aleksandr Smushkovich

(57) ABSTRACT

Proposed devices provide for a jetting process of formation critical areas after opening up a column, increasing a perforator's punch power and reliability, significantly preventing accidents. A hydro-mechanical piercing-type perforator includes a casing containing a hydraulic cylinder with a pusher, an operating tool radially movable and capable of interaction with the pusher. The tool is designed as a puncher, placed on a piston (plunger), mounted in a camera. The tool includes at least one through hydraulic channel and a jet. The camera is hydraulically connected with the cylinder. A proposed method for operating the perforator includes supplying a working fluid to the perforator through the column, creating pressure of the working fluid for an extension mechanism actuating the tool, extending the tool by applying the pressure through a piston rod system, to the piston with the puncher, and applying pressure to the piston through the hydraulic cylinder to the chamber.

10 Claims, 8 Drawing Sheets

HYDROMECANICAL PIERCING PERFORATOR AND METHOD OF OPERATION THEREOF

FIELD OF THE INVENTION

The proposed invention relates to drilling and well operations, in particular to the design of devices for drilling-in of productive stratums through a piercing perforation, and may be used in the construction and repair of wells for various purposes.

BACKGROUND OF THE INVENTION

In the prior art, there are known devices for perforation of wells by piercing, disclosed in Russian Federation Patents RU 2129655 C1, IPC 6 E21B 43/112, 27 Apr. 1999; RU 2355877 C2, IPC E21B 43/112, 20 May 2009, including a casing, tool pistons with piercing elements—punchers with a mechanism of their extension, which is based on the principle of fluid expansion during heating and making of its high-pressure supplied to the tool pistons, as a result a radial moving of the tool pistons and an extension of the punchers happen. Significant disadvantages of these devices are low productivity, insecurity and design complexity, including energy drive with a heat source. Moreover, such perforator designs exclude a jetting process possibility of a critical area of formation immediately after an opening up of the column, which reduces the efficiency of the opening up.

In the prior art a large number of piercing perforating devices are known, their method of operation is based on the extension of pushers by hydraulic mechanisms disclosed in Russian Federation Patents: RU 2373382 C1, IPC E21B 43/112, 20 Nov. 2009; RU 2172394 C1, IPC 7 E21B 43/112, 20 Aug. 2001; RU 2069741 C1, IPC 6 E21B 43/112, 27 Nov. 1996; RU 2069740 C1, IPC 6 E21 B 43/112, 27 Nov. 1996, RU 2043486 C1, IPC 6 E21B 43/114, 10 Sep. 1995. The devices include a casing, comprising a system of chambers, pistons and rods, leading the working fluid coming to the perforator through the column of tubings to the punch piston. Such hydraulic mechanisms often have a low penetration. In order to increase the penetration they can include pressure boosters, which complicate the devices' design and increase manufacturing costs, the productivity and efficiency of the devices are not high enough at the same time. Moreover, when using such perforators with boost pressures the tightness problems of all design units and accelerated wear of seal elements of the pistons are arisen.

In the prior art, there is known a device for creating perforating channels in a casing string according to Russian Federation Patent RU 2395671 C1, IPC E21B 43/112, 27 Jul. 2010. The device comprises a tube and support housings, a cylinder connected to the support housing and comprising an actuating piston with a return spring and a slip pusher, equipped with working cutters longitudinally moveable in relation to the slip pusher when actuated by the support housing, a valve gear with its casing, mounted above the cylinder, and a secondary return spring, and the tube housing is connected to the piston to perform a constrained longitudinally movement. The cylinder above the support housing is provided with a ring seat, the piston has a collar, and the return spring is mounted between the external collar of the piston and the ring seat of the cylinder. The tube housing has a seat above the ring collar of the piston, while the secondary return spring is mounted between the seat and the piston in the cylinder. The casing of the valve gear is fixedly connected with tube housing and it has a valve seat at the top and an unsealed internal seat at the bottom. The spring is applied to press the valve to the seat of the valve gear casing from the internal seat, so that to hold a liquid column forcing the valve in the perforation interval.

The connection of the valve gear and tube housing can be made built-up (for example, a thread) for convenience of assembling and disassembling. The number of cylinders and their respective actuating pistons is selected based on forces necessary for the opening up of the casing string of the well: the thicker wall of the casing string, the greater a number of cylinders with the actuating pistons need to be used. Unauthorized overflows of liquid in the device are excluded by seals.

This device has no disadvantages of hydraulic piercing-type perforators, it has a high punch capability, sufficient power and it opens up the column effectively, but its design excludes the jetting process possibility of a critical area of formation immediately after the opening up of the column, which reduces the efficiency of the opening up.

To offer a more powerful device for drilling-in the effort is made in the useful model according to Russian Federation Patent RU 115407 U1, IPC E21B 43/114, 27 Apr. 2012. This device is the closest analog of the proposed invention and it is herein further referred to as a 'prototype'.

The prototype device for creating of perforating channels in the well comprises a casing, a wedge with grooves, at least two hydraulic cylinders placed one behind the other with connected piston rods, one of which is spring-loaded, and at least two cutters with jets and cutters' holders, placed in grooves of a support and a wedge with an ability of radial reciprocating moving, the casing is made by the wedge and walls of the hydraulic cylinders, in which the piston rods are made with an axial channel connected downpipe with their piston cavities and with tubes of cutters' jets through channels in the cutters' holders, the support of which is connected to the piston rod, which is spring-loaded downward relative to the hydraulic cylinder.

The disadvantage of the device according to the prototype is unreliability of the design of the working fluid supply in the jet nozzle. There is a high probability of a pipe break or seal failure of the pipes in operating conditions; therefore not only caverns washout would be impossible to execute, but also the column opening, because the working fluid from the hydraulic cylinders would flow through the tube during creating an operating pressure. This can lead to an emergency in the well.

OBJECT AND SUMMARY OF THE INVENTION

The objective of the proposed invention is to create a highly efficient and reliable design of a hydro-mechanical piercing perforator and a method of operation thereof, providing a guaranteed opening up of the production string and the possibility of a subsequent jetting process of a critical area of formation in the area of opening.

The proposed invention achieves the following result:

1. Increasing the punch force, improving the quality of the opening up of the production string (herein also called 'column'), increasing productivity of the perforator.
2. Increasing the perforation efficiency and improving the hydrodynamic connection to the layer due to a guaranteed possibility of the jetting process of a critical area of formation immediately after the opening of the column.
3. Reducing accidents, increasing the reliability of the perforator.

The mentioned result is achieved by providing a method of puncher ejection in a piercing perforator, including a puncher, wherein this method is based on a combination hydro-mechanical principle of operation: a tool piston or a plunger of the puncher is affected by mechanical force of a wedge pusher and, on the other hand, at the same time, by hydraulic pressure force of a working fluid, supplied to a process chamber (herein also called 'chamber') of the tool piston (or the plunger).

The inventive hydro-mechanical piercing perforator comprises: a casing; at least one operating hydraulic cylinder placed in the casing; at least one wedge pusher (i.e. a pusher having a wedge shape); at least one operating tool, including at least one through hydraulic channel and at least one hydro-monitor (herein also called 'jet nozzle'); wherein the operating tool is capable of interaction with the wedge pusher, and capable of radial movement as a result of the interaction.

According to the invention, the operating tool is designed as a piston with a puncher (tool piston), which piston is equipped by seals, mounted in the chamber; or a plunger with a puncher (tool plunger) mounted in the chamber, which chamber is equipped by seals; and the chamber is designed with a capability of hydraulic connection with the operating hydraulic cylinder.

The connection of the process chamber of the tool piston (plunger) with the hydraulic cylinder can be designed in different ways.

The chamber is connected with the operating hydraulic cylinder by means of one or several channels made in the wedge pusher.

The chamber is connected with the operating hydraulic cylinder by means of areas (flats, chamfers) or grooves made on the external surface of the wedge pusher.

The chamber is connected with the operating hydraulic cylinder by means of grooves, made on the internal surface of the perforator's casing, or on the external surface of the wedge pusher and on the internal surface of the casing.

The chamber is connected with the operating hydraulic cylinder by means of one or several channels made in the perforator's casing.

The wedge pusher of the perforator can be equipped by seals, in which case the wedge pusher is embodied as a piston.

A cavity, wherein the wedge pusher is moving, can be equipped by seals, in which case the wedge pusher is embodied as a plunger.

The method of operation of the inventive hydro-mechanical piercing perforator comprises: supplying a working fluid to the perforator through a column of pump compression tubes (herein also called "tubings"); creating an operating pressure of the working fluid for actuating an extension mechanism of the operating tool; extending the operating tool; and carrying out the perforation. According to the method of the invention, the extension of the operation tool is made:—by impact of the pressure of working fluid transmitted through a piston-rod system to the wedge pusher, in turn, pushing the tool piston (plunger) with the puncher; and also—by impact on the tool piston (plunger) of the working fluid supplied under pressure through the hydraulic cylinder of the perforator to the process chamber of the tool piston (plunger).

Designing the operating tool in the form of a piston with a puncher or a plunger with a puncher (tool piston/plunger) enables supply of the operating fluid pressure to the operating tool and creating an additional force, directed at the extension of the operating tool. Designing the chamber of the tool piston/plunger with a capability of hydraulic connection with the operating hydraulic cylinder enables supply of the operating fluid to the chamber from the hydraulic cylinder for impact on the tool piston/plunger. Thus, proposed design and the method of operation of the perforator provide for a double force impact on the puncher, which is a combination of the mechanical force of the wedge pusher and the hydraulic force of operating fluid applied to the tool piston/plunger. This double force impact increases the punching capability of the puncher, and improves quality of the opening up of the production string (column).

Moreover, designing the chamber of the tool piston/plunger with a capability of hydraulic connection with the operating hydraulic cylinder enables supplying the operating fluid to the hydraulic channel of a nozzle of the hydro-monitor, so that immediately after opening the column up the jetting process of the critical area of formation can be done, that significantly increases the efficiency of the opening up of the column.

If the wedge pusher of the perforator is made in the form of a piston or plunger, it can carry out a function of an additional hydraulic cylinder, thereby increasing the operating force applied to the tool piston/plunger.

The proposed design and the method of operation of the inventive device is characterized with simplicity and reliability, which allows for a trouble-free operation of the perforator.

BRIEF DESCRIPTION OF DRAWINGS

The claimed device in several variants of its implementation is shown in FIGS. 1-8:

DETAIL DESCRIPTION OF PREFERRED EMBODIMENTS OF THE INVENTION

Figure 1:
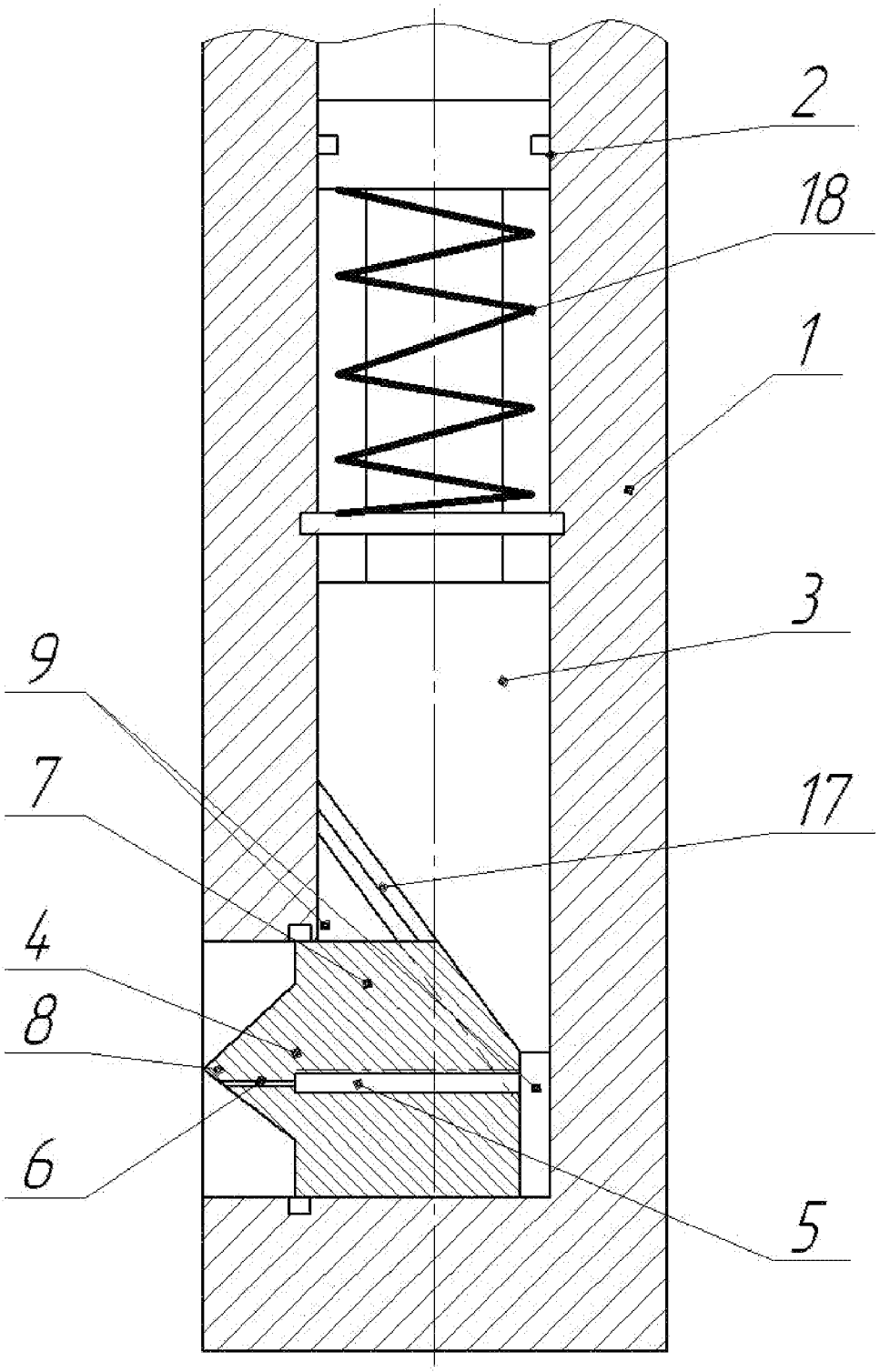
FIG. 1 depicts the device in the longitudinal section in a transportation position.
Figure 2:
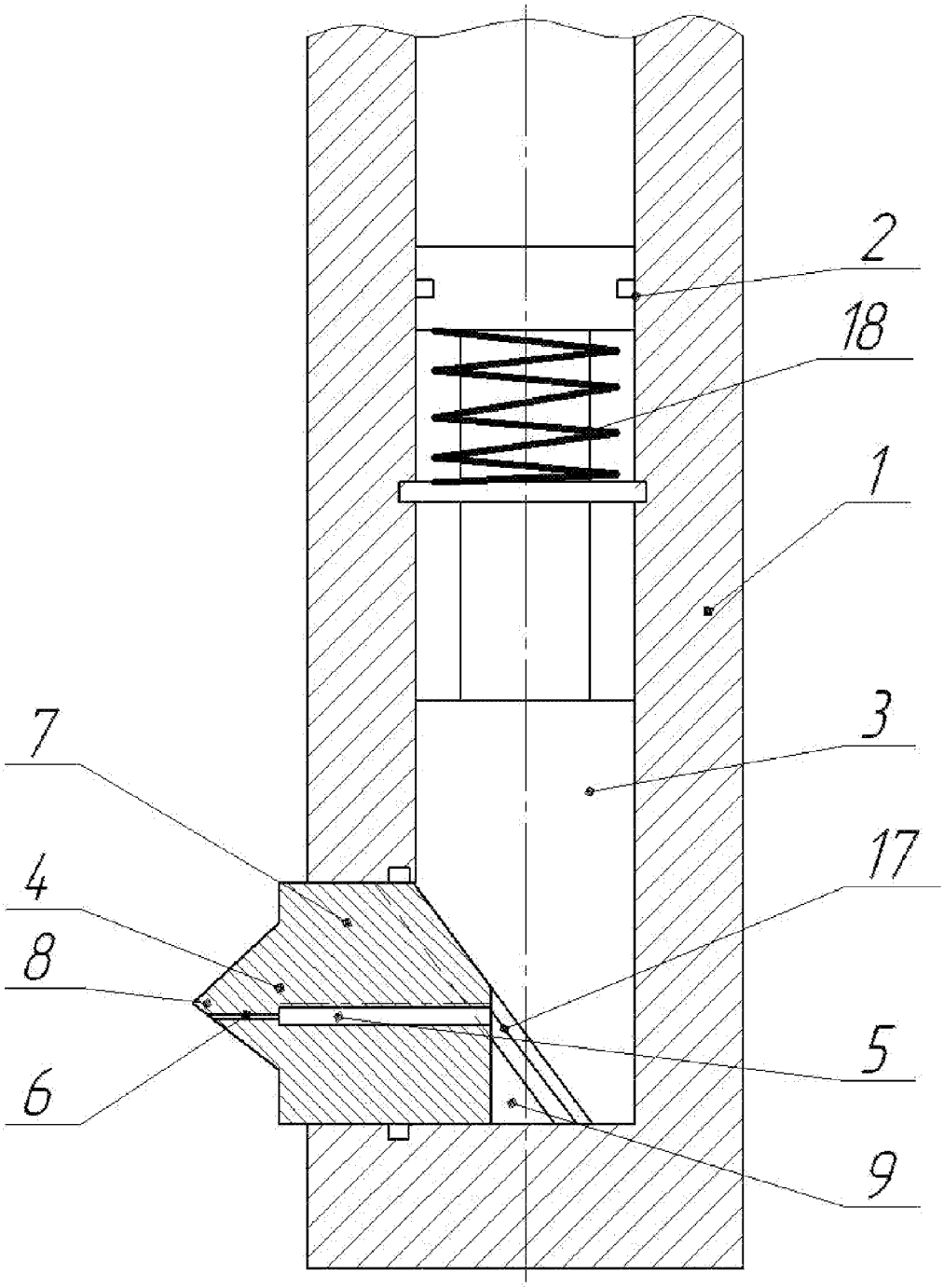
FIG. 2 depicts the device in the longitudinal section in the operating position.
Figure 3:
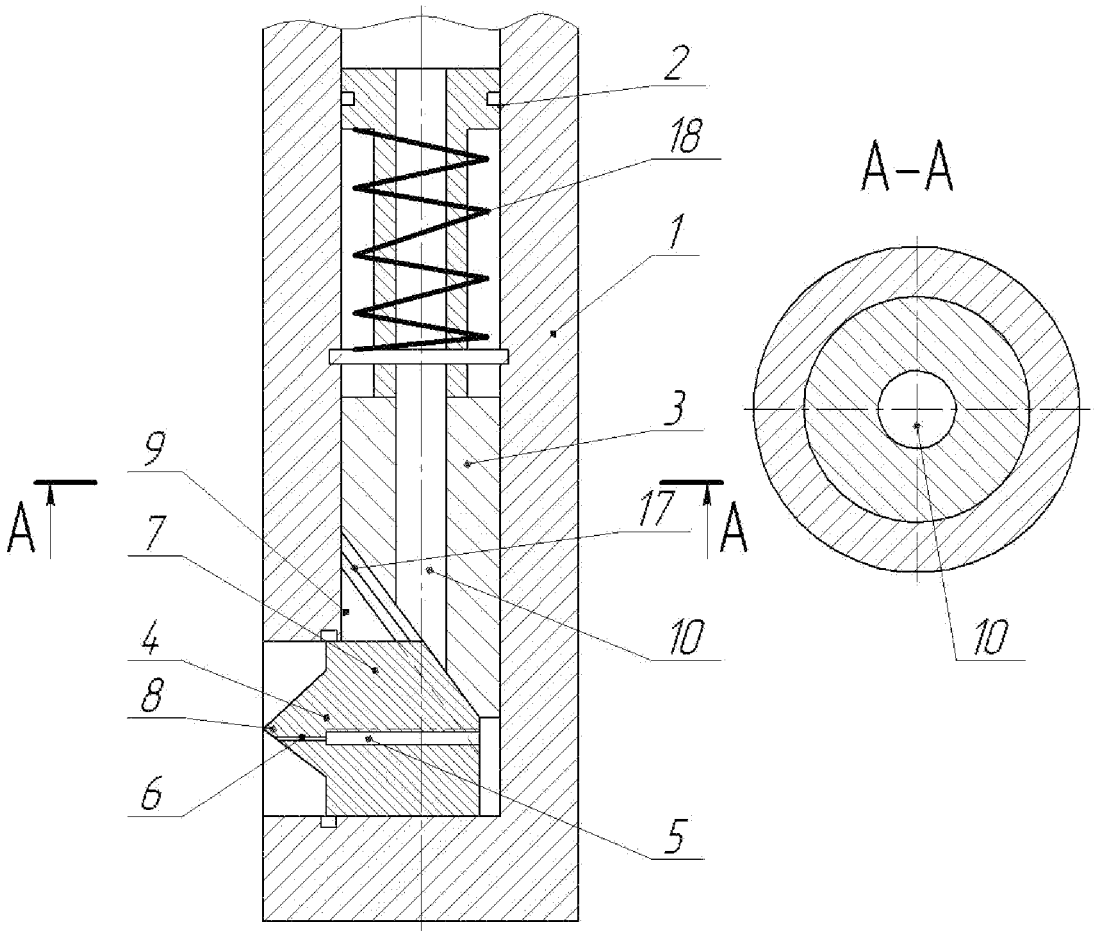
FIG. 3 depicts a version of the device with channels formed in the wedge pusher.
Figure 4:
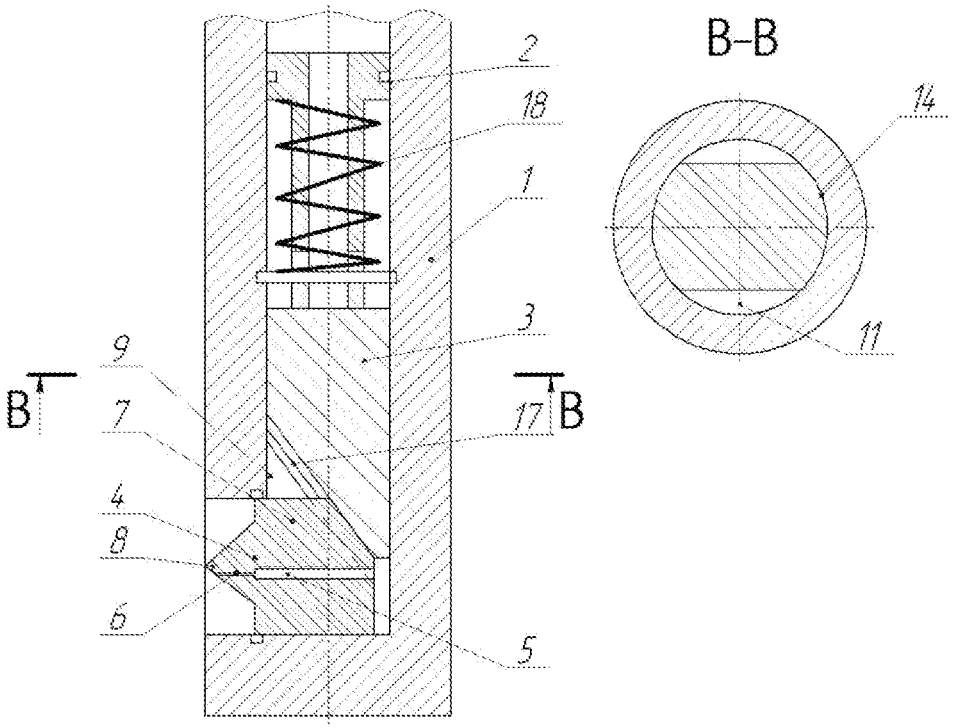
FIG. 4 depicts a version of the device with areas (flats) made on the external surface of the wedge pusher.
Figure 5:
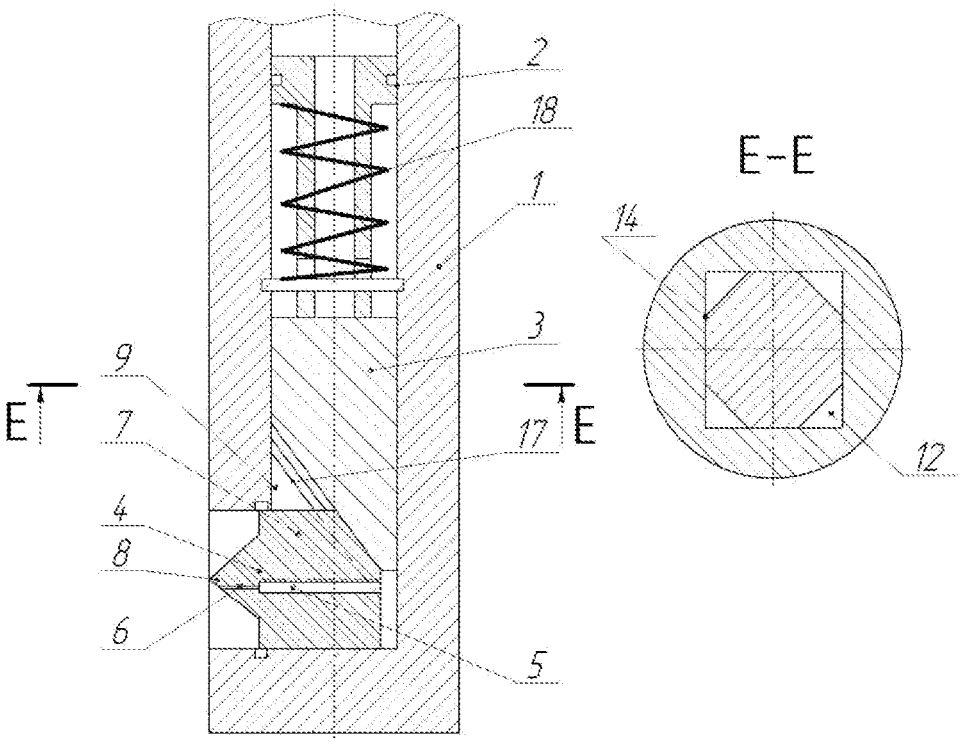
FIG. 5 depicts a version of the device with areas (chamfers) made on the external surface of the wedge pusher.
Figure 6:
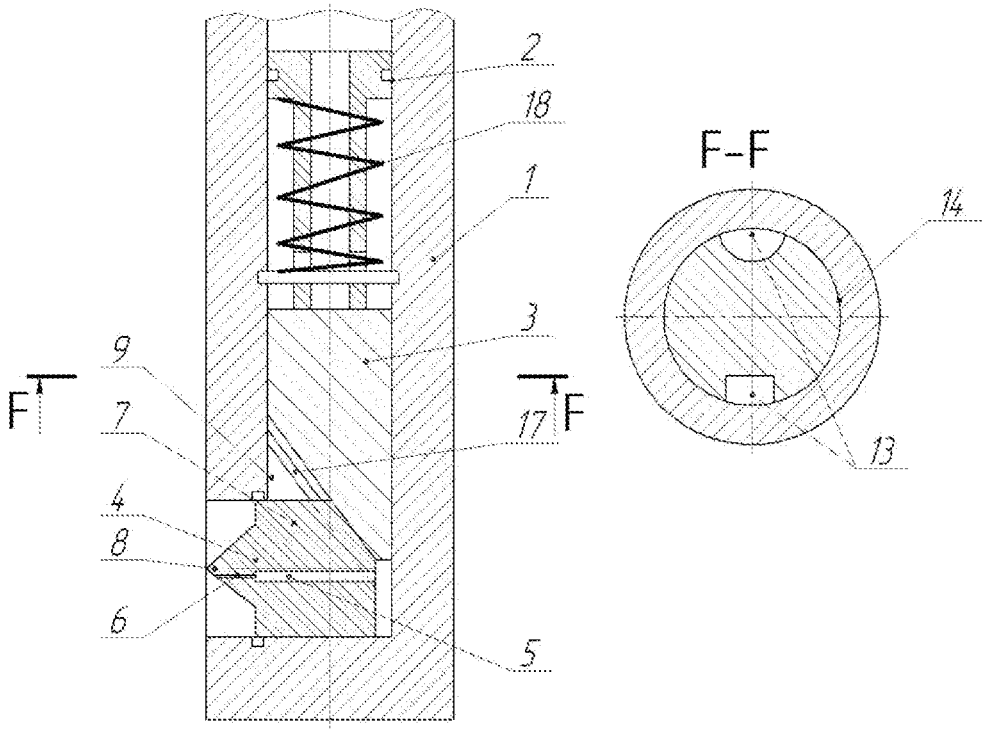
FIG. 6 depicts a version of the device with grooves made on the external surface of the wedge pusher.
Figure 7:
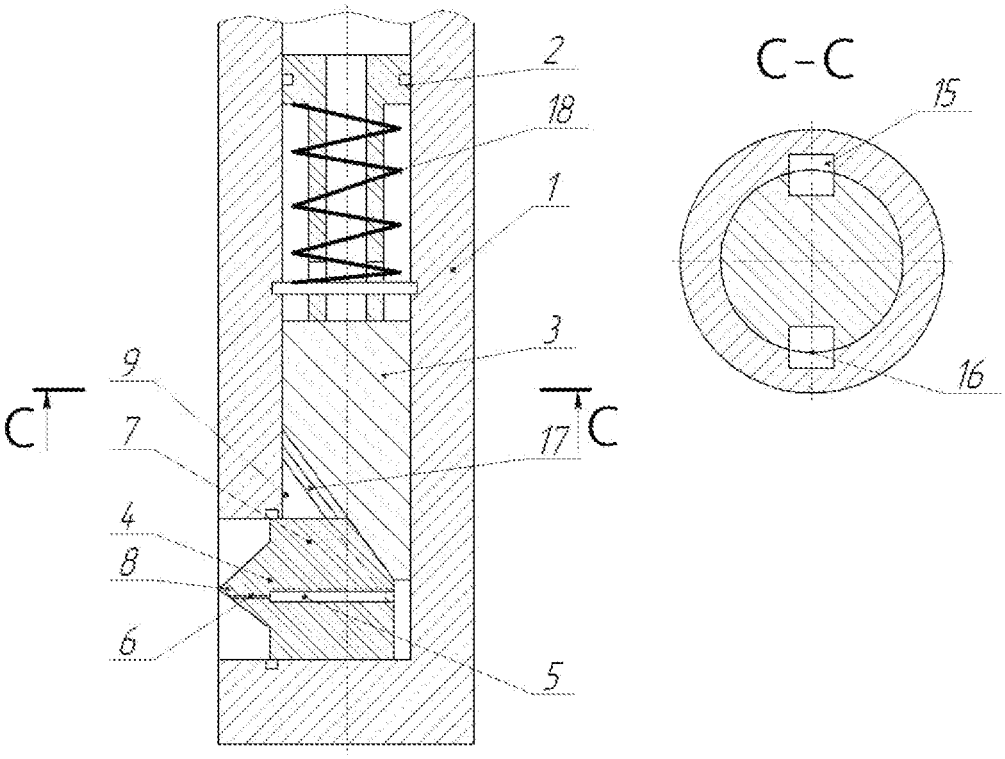
FIG. 7 depicts a version of the device with cavities, made on the internal surface of the perforator's casing and the surface of wedge pusher.
Figure 8:
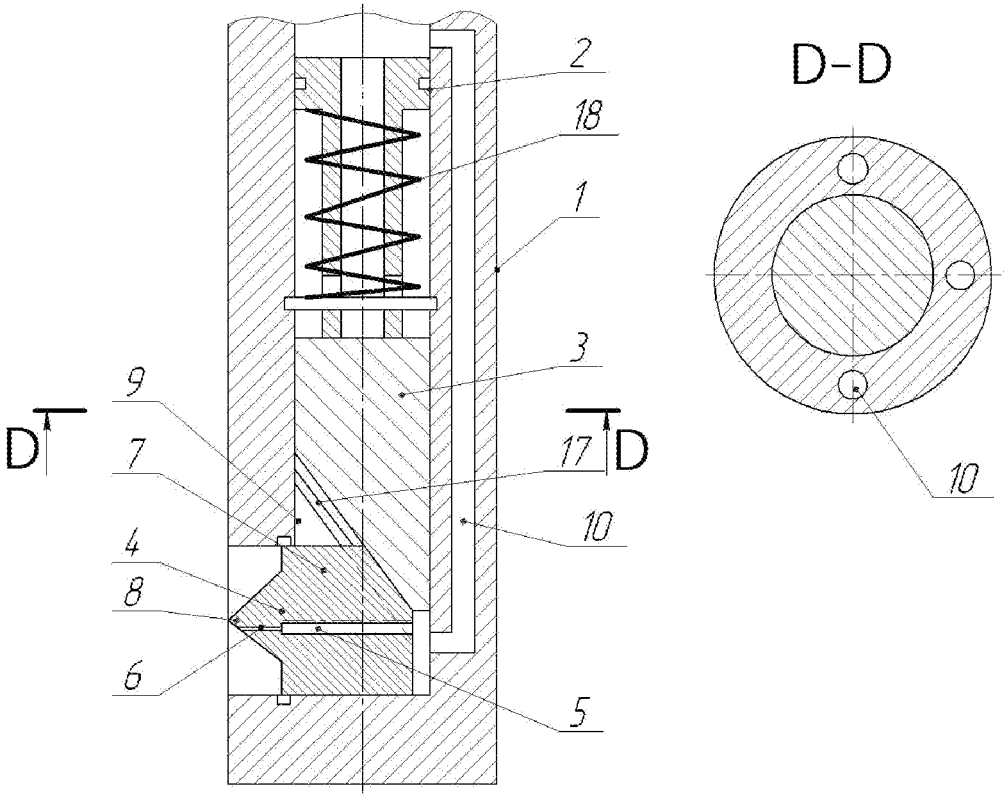
FIG. 8 depicts a version of the device with channels made in the perforator's casing.

According to a preferred embodiment of the invention, the device comprises a casing 1, at least one operating hydraulic cylinder 2, placed in the casing 1, at least one wedge pusher 3, at least one operating tool 4, which includes at least one through hydraulic channel 5 and at least one jet 6. The operating tool 4 is mounted with a capability of interaction with the wedge pusher 3 and a capability of radial movement. The operating tool 4 is designed as a plunger 7 with a puncher 8 (of the tool plunger 7), mounted in a process chamber 9, wherein the chamber 9 is designed with a capability of hydraulic connection with the operating hydraulic cylinder 2.

The connection of the process chamber 9 of the tool plunger 7 with the hydraulic cylinder 2 can be carried out by means of channels 10, made in the wedge pusher 3, or by means of areas (flats 11, chamfers 12) or grooves 13, made on an external surface 14 of the wedge pusher 3, or by means of grooves 15, made on an internal surface 16 of the perforator's casing 1, or made on the external surface 14 of the wedge pusher 3 and on the internal surface 16, or, for example, by means of one or several channels 10, made in the perforator's casing 1.

The inventive device operates as follows. The perforator secured on the column of pump-compressor tubes (tubings) is lowered into the well, the working fluid is supplied to the perforator, and the operating pressure is created for actuating the extension mechanism of the operating tool 4. The extension of the operation tool 4 is made by impact of the working fluid pressure through a piston rod system, including one or several hydraulic cylinders 2, upon the wedge pusher 3, while the wedge pusher 3 pushes the tool piston/plunger 7 with the puncher 8, and also by impact of the working fluid on the tool piston/plunger 7, while the working fluid is supplied under pressure through a hydraulic cylinder 2 of the perforator to the process chamber 9 of the tool piston/plunger 7. As a result of the application of the combined hydro-mechanical forces to the tool piston/plunger 7, it moves radially, pushing the puncher 8 and thereby opening up the column. Thereafter, the processing of the critical area of formation is executed, if it is necessary, through the jet nozzles 6.

Upon completion of the work, the inventive device is brought in the transportation position by a known manner, for example as follows: the working fluid pressure is released, under the influence of one or several springs 18, the operating hydraulic cylinder 2 and the wedge pusher 3 are moved to an uppermost position, with the help of a T-shaped connection 17 or a connection of the "dovetail" type, the wedge pusher 3, moving up, retracts the operating tool 4 into the casing, thereby placing it in the transportation position.

The perforator is lifted on the surface or transferred to a new perforation interval.

I claim:

1. A piercing perforator comprising:

a casing (1):

at least one operating hydraulic cylinder (2) placed in the casing (1); said operating cylinder (2) is operatively supplied with a working fluid characterized with a hydraulic pressure:

at least one wedge pusher (3) slidably mounted in the casing (1); wherein said hydraulic pressure is operatively applied to the wedge pusher (3) urging said wedge pusher (3) to move down: said wedge pusher (3) includes a lower slope surface;

a process chamber (9) mounted in the casing (1) under said wedge pusher (3); said process chamber ('9') is operatively supplied with the working fluid through said operating hydraulic cylinder (2) via at least one passage formed in the wedge pusher (3) or the casing (1);

at least one operating tool (4), designed as a puncher (8) secured on a piston or plunger (7); the operating tool 4) is mounted adjacently to the process chamber (9) such that said hydraulic pressure is operatively applied to the operating tool (4); wherein the operating tool (4) includes a upper slope surface operatively capable of mechanical interaction with the lower slope surface of said wedge pusher (3): and wherein: said operating tool (4) is operatively urged to perform a linear radial movement as a result of simultaneous actions of: (a) said interaction of the upper slope surface of said operating tool (4) with the lower slope surface of said wedge pusher (3), and (b) applying said hydraulic pressure to the operating tool (4).

2. The piercing perforator according to claim 1, wherein the process chamber (9) is connected with said operating hydraulic cylinder (2) by means of the at least one passage which comprises at least one channel (10) made in the wedge pusher (3).

3. The piercing perforator according to claim 1, wherein said wedge pusher (3) is characterized with an external surface (14); and the process chamber (9) is connected with said operating hydraulic cylinder (2) by means of the at least one passage which comprises flats (11), or chamfers (12), or grooves (13), made on the external surface (14).

4. The piercing perforator according to claim 1, wherein said wedge pusher (3) is characterized with an external surface (14), and said casing (1) is characterized with an internal surface (16); and the process chamber (9) is connected with said operating hydraulic cylinder (2) by means of the at least one passage which comprises grooves (15), made on the internal surface (16), or made on the internal surface (16) and on the external surface (14).

5. The piercing perforator according to claim 1, wherein the process chamber (9) is connected with said operating hydraulic cylinder (2) by means of the at least one passage which comprises at least one channel (10) made in the casing (1).

6. The piercing perforator according to claim 1, wherein the wedge pusher (3) has seals and is therefore embodied as a piston.

7. The piercing perforator according to claim 1, wherein said casing (1) further includes a cavity for movement of the wedge pusher (3), wherein the cavity has seals, and the wedge pusher (3) is therefore embodied as a plunger.

8. The piercing perforator according to claim 1, wherein said operating tool (4) further defines a back surface situated opposite to the puncher (8); and said process chamber (9) defines walls operatively formed at least by: at least a portion of the lower slope surface and at least a portion of said back surface.

9. The piercing perforator according to claim 1, wherein said operating tool (4) is equipped at least with: at least one through hydraulic channel (5), hydraulically connected with said process chamber (9); and at least one jet nozzle (6) hydraulically connected with said hydraulic channel (5).

10. A method of operation of a piercing perforator connected to a column of tubings; said perforator includes an operating tool furnished with a puncher secured thereon, said operating tool is mounted in a process chamber hydraulically connected with a hydraulic cylinder operatively containing a working fluid, and said operating tool is capable of interaction with a wedge pusher via a piston-rod system connected with the hydraulic cylinder, said operating tool is in direct contact with the working fluid operatively contained in the process chamber; said method comprising the steps of:

supplying the working fluid under pressure to the hydraulic cylinder through the column of tubings;

creating a mechanical pressure applied to the operating tool through the piston-rod system and the wedge pusher and simultaneously supplying the working fluid from the hydraulic cylinder to the process chamber via at least one passage formed in the wedge pusher (3) or the casing (1), thereby creating a hydraulic pressure applied to the operating tool;

radially extending the operating tool under simultaneous impact of the mechanical pressure and the hydraulic pressure; and performing a perforation by the puncher.

* * * * *